US005503267A

United States Patent [19]

Sutherland

[11] Patent Number: 5,503,267

[45] Date of Patent: Apr. 2, 1996

[54] CAN CLIP CARRIER WITH GLUE FLAPS

[75] Inventor: Robert L. Sutherland, Kennesaw, Ga.

[73] Assignee: Riverwood International Corporation, Atlanta, Ga.

[21] Appl. No.: 419,862

[22] Filed: Apr. 11, 1995

[51] Int. Cl.[6] ..... B65D 75/00

[52] U.S. Cl. ..... 206/148; 206/153; 206/158

[58] Field of Search ..... 206/147, 148, 206/149, 153, 154, 158, 161

[56] References Cited

U.S. PATENT DOCUMENTS

| | | | |
|---|---|---|---|
| 3,404,912 | 10/1968 | Watts | 206/158 |
| 3,612,266 | 10/1971 | Graser | 206/158 |
| 3,698,550 | 10/1972 | Graser | 206/158 |
| 5,103,971 | 4/1992 | Schuster | 206/153 |
| 5,323,895 | 6/1994 | Sutherland et al. | 206/161 |
| 5,415,278 | 5/1995 | Sutherland | 206/158 |

*Primary Examiner*—David T. Fidei

[57] ABSTRACT

A carrier for articles such as beverage cans of the type that grip the top portions of the cans so as to suspend them from the carrier. The upper ends of the cans extend through apertures in the bottom panel of the carrier, and the chimes or lips of the cans are engaged by support tabs surrounding the aperture. Glue flaps foldably connected to one of the support tabs at each aperture overlie the upper ends of the cans and are glued to the top panel. An opening in the support tab includes an edge which functions as the support edge. In addition, the bottom panel finger holes have a straight transverse inner edge connected to a cover tab along a score line. Spaced arcuate score lines in the bottom panel cause the intervening segments of the bottom panel to buttress the inner edge.

22 Claims, 3 Drawing Sheets

CAN CLIP CARRIER WITH GLUE FLAPS

FIELD OF THE INVENTION

This invention relates to article carriers. More particularly, it relates to article carriers that grip the upper portion of articles so as to suspend them from the carrier.

BACKGROUND OF THE INVENTION

It is known to employ paperboard carriers which grip the top portions of cans so that most of the can height is unenclosed. One such carrier design consists of a top panel spaced from a bottom panel by short side panels, with the top portions of the cans located in the space between the top and bottom panels. The cans are introduced to the carrier through apertures in the bottom panel and typically are held in place by support tabs which extend up from the bottom panel to engage the underside of the can chimes. Finger openings in the top panel or in both top and bottom panels enable the carrier to be lifted and carried.

Paperboard carriers of this type are more comfortable to carry than the thin plastic carriers which are sometimes used to grip the top portions of beverage cans. They are inexpensive to manufacture, are environmentally acceptable and include a substantially unbroken top panel surface which not only prevents dirt from accumulating on the tops of the cans but also provides ample space for printed indicia. Certain designs, however, make it difficult to engage the can chimes with support tabs throughout the circumference of the can. For example, it is desirable to provide glue flaps which extend up from the bottom panel and overlie a portion of the can tops, placing them in position to be glued to the top panel. Such glue flaps supplement the usual overlapping type of glue flap that runs along the edge portions of the carrier, strengthening the carrier. Because space limitations require the supplemental glue flaps to be foldably connected to the bottom panel adjacent the aperture through which the cans extend, the flaps take up a significant circumferential portion of each aperture, so that there is no room for a support tab in that location. The lack of support for the container in this area is a problem which was addressed in U.S. Pat. No. 5,103,971, dated Apr. 14, 1992. In the design disclosed in the patent a support tab is provided between spaced legs of a supplemental glue flap, with the spaced legs being connected to the bottom panel of the carrier. While this arrangement results in the provision of support tabs which substantially continuously engage the chime of an associated can, there is a danger that the short connections between the supplemental glue flaps and the bottom panel may tear when exposed to lifting stresses. Another problem is the potential for the area of the bottom panel between the finger holes and adjacent can-receiving openings to tear or distort when subjected to lifting stresses.

It is therefore an object of the invention to strengthen the supplemental glue flaps of a clip-type carrier while readily supporting the packaged articles substantially throughout their circumference. Another object of the invention is to additionally reinforce the area of the bottom support panel between the finger holes and the adjacent article-receiving openings.

SUMMARY OF THE INVENTION

The invention is directed to a package formed by a carrier which supports articles by their upper portions. The carrier is of the type which includes a top panel, a spaced bottom panel and short side panels, the bottom panel containing apertures through which the upper portions of the articles extend. A plurality of support tabs foldably connected to the bottom panel adjacent the apertures extend generally toward the top panel and engage the lip of associated articles. One of the support tabs associated with at least one of the apertures is connected to a glue flap which overlies at least a portion of the upper surface of an associated article. An opening in the support tab includes an edge which is the support edge of the tab. This arrangement allows support tabs to be positioned substantially throughout the entire circumference of the apertures while at the same time permitting the glue flap to have a strong connection to the bottom panel of the carrier. In a preferred arrangement a glue flap is provided at each aperture.

In a typical package the articles are arranged in two adjacent rows, and the support tabs which are connected to the glue flaps in one row are adjacent to and opposite similar support tabs in the other row. Other support tabs on the opposite side of the apertures from these support tabs are connected to the bottom panel substantially along a fold line connecting the bottom panel to the side panels, which provides additional support to the structure.

If finger holes are provided in both the top and bottom panels it is preferred that each bottom panel finger hole have an inner transverse edge and be at least partially covered by a tab connected to that edge by a score line. A second transverse score line, preferably arcuate, extends from the ends of the adjacent inner transverse edge. When the package is lifted by the finger holes the second transverse score line acts as a buttress to prevent the area of the bottom panel between the score lines from tearing or crushing. An additional arcuate score line may be spaced from each second transverse score line to further strengthen the bottom panel during lifting.

The features of the invention which enable it to provide the desired results are brought out in more detail below in connection with the preferred embodiment, wherein the above and other aspects of the invention, as well as other benefits, will readily become apparent.

DETAILED DESCRIPTION OF THE PREFERRED EMBODIMENT

Figure 1:
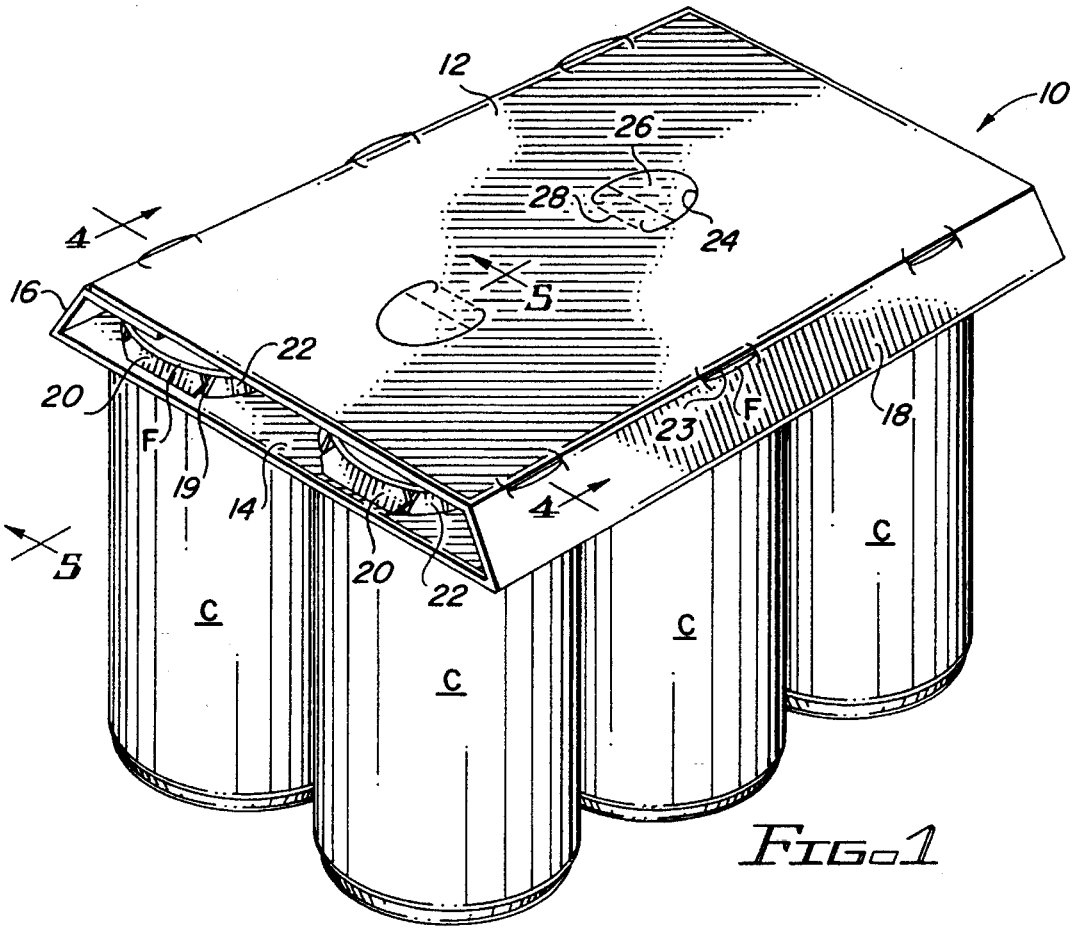
FIG. 1 is a pictorial view of a package comprised of the carrier of the present invention and six beverage cans supported by the carrier.

Referring to FIG. 1, a carrier 10 is comprised of a top panel 12 connected to bottom panel 14 by side panels 16 and 18. The upper portions of cans C extend through openings 19 in the bottom panel 14 and are supported by a number of support tabs of which tabs 20 and 22 are visible. Portions of the can chimes F extend through slots 23 in the carrier. The side panels are very short, so that the space between the top and bottom panels where the cans are supported is quite small. Finger holes 24 covered by tabs 26 are foldably connected to the top panel 12 along fold lines 28. The finger holes are aligned with finger holes in the bottom panel, not visible in this view.

Figure 2:
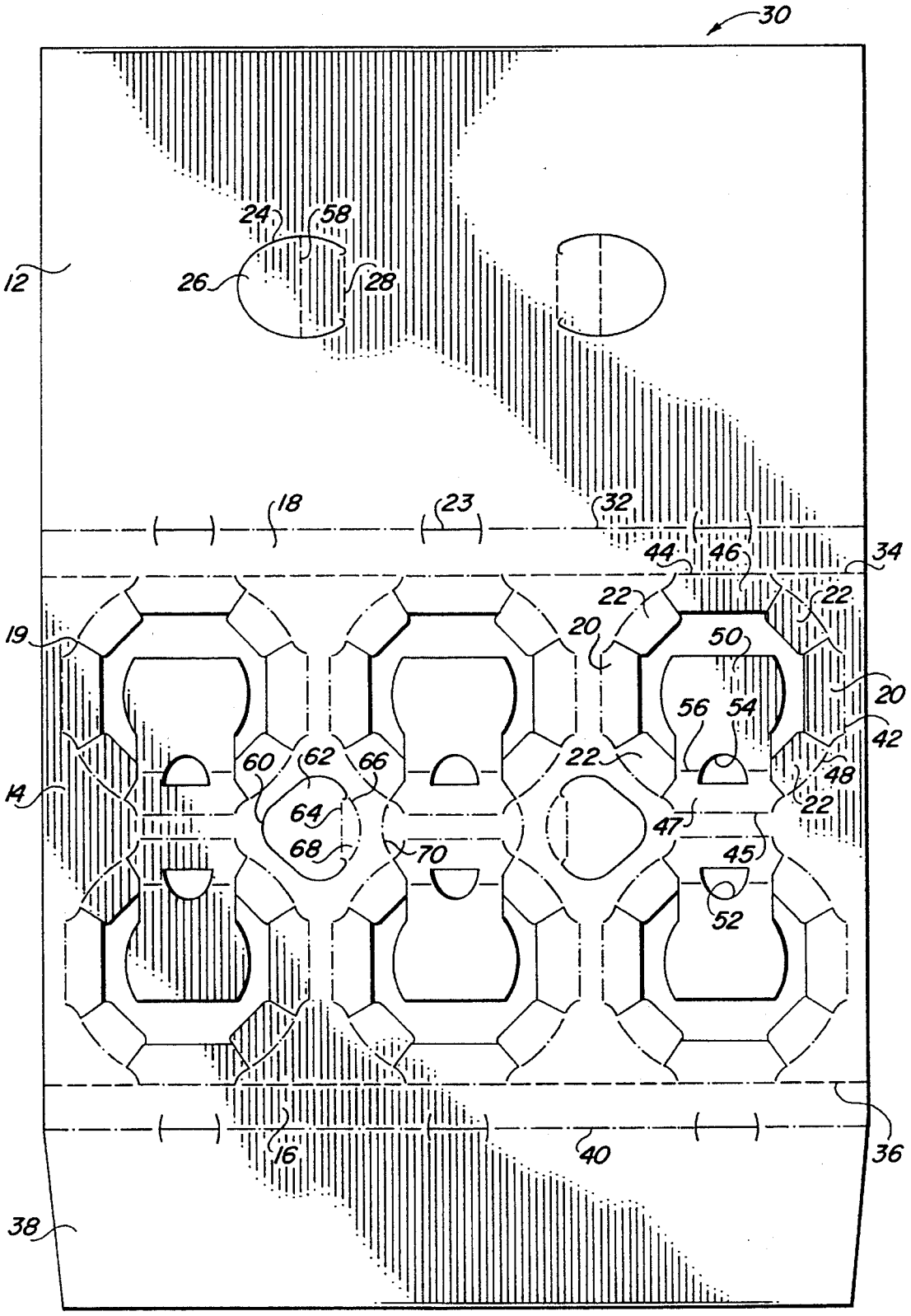
FIG. 2 is a plan view of a blank for forming the carrier of FIG. 1.

Referring to FIG. 2, wherein like reference numerals to those used in FIG. 1 denote like structure, the carrier is formed from a substantially rectangular blank 30 of flexible sheet material, such as paperboard. The blank is divided into a top panel section 12, a bottom panel section 14 and side panel sections 16 and 18. The top panel section 12, which is somewhat narrower than the bottom panel section 14, is connected to the side panel section 18 by fold line 32, and the side panel section 18 is connected to the bottom panel section 14 by parallel fold line 34. The side panel section 16 is connected to the bottom panel section 14 by fold line 36 and to glue flap 38 by fold line 40.

The bottom panel section 14 is provided with two rows of three apertures 19 to form a grouping of six adjacent apertures. Each aperture is ringed by a series of support tabs connected to the bottom panel along fold lines forming the boundary of the aperture. Thus, each aperture is defined by the fold lines 42 of opposite support tabs 20, the fold lines 44 and 45 of opposite support tabs 46 and 47, and the fold lines 48 of the support tabs 22. The support tabs 22 are located between the tabs 20 and the tabs 46 and 47, with the tab fold lines 45 being parallel to and spaced from each other by a short distance and the tab fold lines 44 being coincident with the fold lines 34 and 36. Short H-shaped slits 23 are provided in the fold lines 32 and 40 opposite the tabs 46 for receiving portions of the can chimes as described above.

The fold lines 48 of the tabs 22 follow a circular arc whose center of radius is at the center of the can aperture. Although the fold lines 42, 44 and 45 of the tabs 20, 46 and 47 are not arcuate but rather are parallel to the end and side edges of the carrier, the midpoint of these fold lines lies on the same circular arc. The height of the support tabs, as measured radially inwardly from their fold lines, is the same. Thus, although the inner edges of the tabs in FIG. 2 are staggered with respect to adjacent tabs, the radially inwardly directed height of the tabs 20 and 46 is the same as the height of the tabs 22. This arrangement takes into account the curvature of the tabs after they have been pushed out of the plane of the bottom panel and allows all the tabs of an aperture to contact the chime of an associated can.

The support tabs 47 extend radially inwardly of the apertures 19 for a substantial distance, preferably beyond the centers of the apertures, to form glue flaps 50. Each glue flap 50 includes a cutout 52 a portion of which is formed by the edge 54. The edge 54 functions as the support edge of the support tab 47. Fold lines, which may be in the form of short slits 56 located on either side of the cutouts 52, are provided to enable the glue flaps 50 to fold over into their horizontal operative position, as described below.

The finger holes 24 and the flaps 26 in the top panel section 12 are elongated, with the flaps including a transverse fold line 58 intermediate the ends of the flaps. Additional finger holes 60 located in the bottom panel section 14 in the space between the interior and end can apertures are covered by tabs 62 connected to the bottom panel section by score line 64. The score line 64 is perpendicular to the fold lines 34 and 36. In addition, curved score lines 66, which are symmetrically arranged with respect to the fold lines 45 and which form a concave arc with respect to an associated score line 64, extend between the ends of associated score lines 64. The area enclosed by the score lines 64 and 66 is referred to as bottom panel segment 68. Also, the bottom panel section is provided with curved score lines 70 which extend from the slits separating the tabs 22 from the tab 47 in one of the central apertures 19 to the corresponding slits in the other central aperture 19. The score lines 70 face in the opposite direction to the score lines 66.

Figure 3:
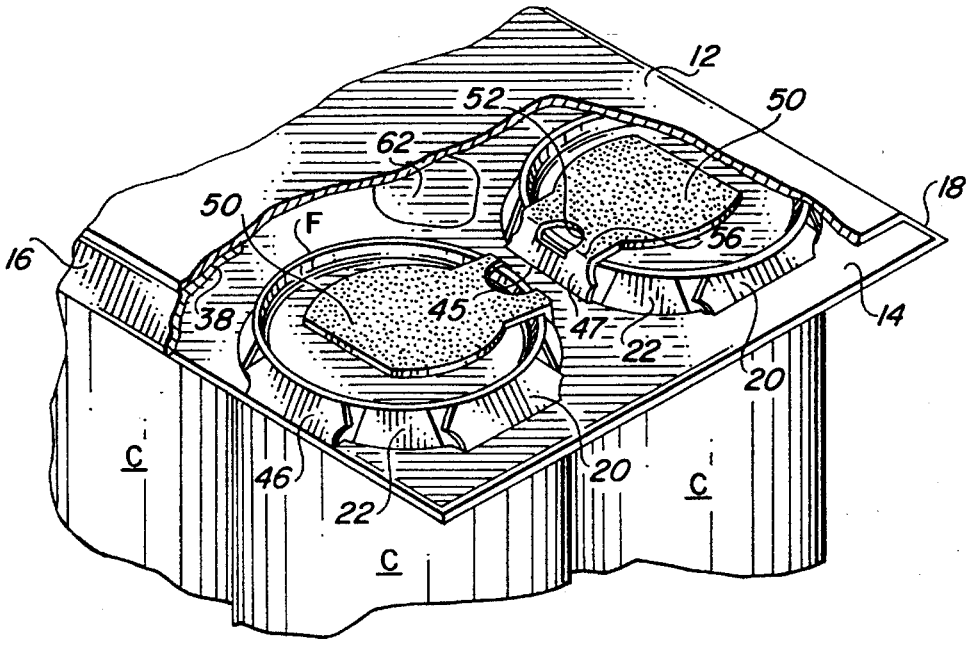
FIG. 3 is an enlarged partial pictorial view showing the support tabs of the invention engaging beverage cans in the carrier.
Figure 4:
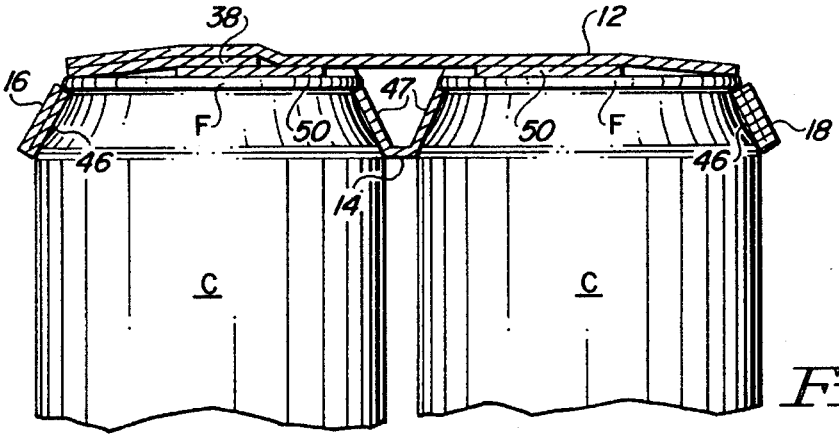
FIG. 4 is a partial transverse sectional view taken on line 4—4 of FIG. 1.
Figure 5:
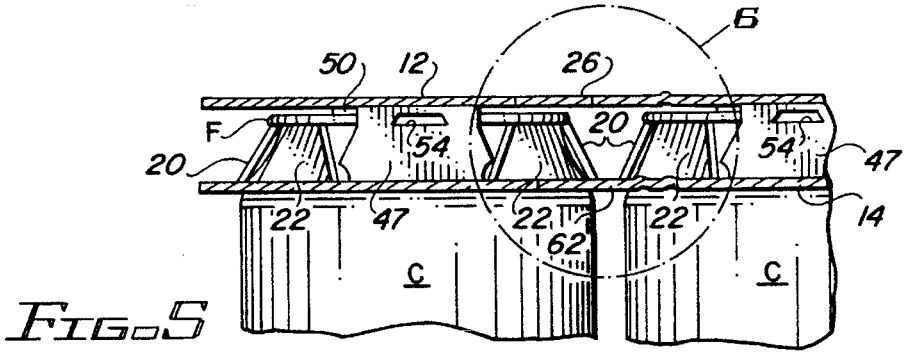
FIG. 5 is a partial transverse sectional view taken on line 5—5 of FIG. 1.

To form a package, the blank of FIG. 2 is positioned on top of a group of six adjacent cans which have been arranged in two rows of three cans each so that the apertures 19 overlie the cans. Relative movement between the apertures and the cans is caused by applying downward pressure to the bottom panel section. The relative upward movement of the tops of the cans pivots the support tabs up until their outer support edges snap into place beneath the can chimes F, engaging the bottom of the chimes as illustrated in FIGS. 3, 4 and 5. The resiliency or memory of the tabs causes them to be biased toward the cans so that after they snap into place the support tab edges remain in contact with the underside of the can chimes. As shown, the tabs are separated slightly as a result of their upward pivoting movement, but still are so closely spaced that they provide substantially continuous support around the circumference of the adjacent portion of the can chime.

After the blank has been moved down over the can tops to actuate the support tabs the blank is folded along lines 32, 34, 36 and 40 to form the side panels. This action folds the glue flap 38 down along the fold line 40 into its final position so that it engages the underside of the top panel 12. It will be understood that prior to the folding operation glue will have been applied to either the glue flap 38 or the area of the top panel that engages the glue flap. Because the bottom panel is wider than the top panel the side panels slope inwardly, pushing the adjacent support tabs 46 against the cans. Thus, as illustrated in FIG. 4, the support tabs 46 contact both the side panels 16 and 18 and the upper tapered portion of the cans. It will be understood that the other support tabs surrounding an aperture also contact the upper tapered portion of the cans to hold them tightly in place, but only the outer tabs 46 are buttressed by the side panels. Also, the narrow top panel and the presence of the slits 23 in the fold lines 32 and 40 results in outer portions of the can chimes extending through the slits, which enables the top panel to be drawn tightly into place prior to the setting of the glue. H-shaped slits are preferred over linear slits because the arcuate transverse cuts at their ends prevents the slits from tearing.

During the relative movement between the bottom panel section of the blank and the cans, the support tabs 47 are pivoted up and inwardly biased toward the side of the cans in the same manner as the other support tabs. The engagement of the can chime by the support edge of a support tab 47 is illustrated in FIGS. 3 and 5. As can be seen, the support tabs provide support throughout the circumference of the can. Without the tab 47 a substantial portion of the can circumference would be unsupported.

When the blank is folded to form the side panels and to cause the outer edge portion of the top panel 12 to overlie the glue flap 38, this action also causes the supplemental glue flaps 50 to be folded down along the fold lines 56 until they engage the underside of the top panel. It will be understood that prior to the folding operation, glue, indicated by the stippling on the glue flaps 50, will have been applied to either the glue flaps 50 or the areas of the top panel that engage the glue flaps 50.

It will be noted that the glue flaps 50 have been made quite long so that in the carrier they extend out to about the center of the can top. This maximizes the area of contact between the glue flaps 50 and the top panel 12, strengthening the connection between the glue flaps and the top panel and lessening the chance of bowing of the top panel with respect to the bottom panel. Because the glue flaps 50 are extensions of the support tabs 47, which are connected along the full length of the fold lines 45 to the bottom support panel, the glue flaps are solidly connected to the bottom panel with little risk of tearing.

Figure 6:
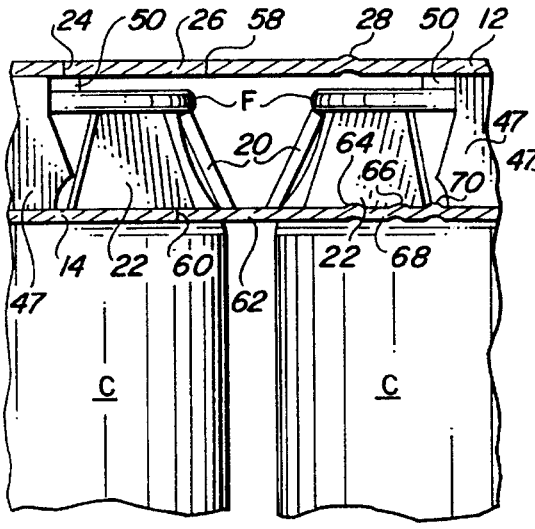
FIG. 6 is an enlarged partial transverse sectional view of the area enclosed by the circle 6 of FIG. 5.
Figure 7:
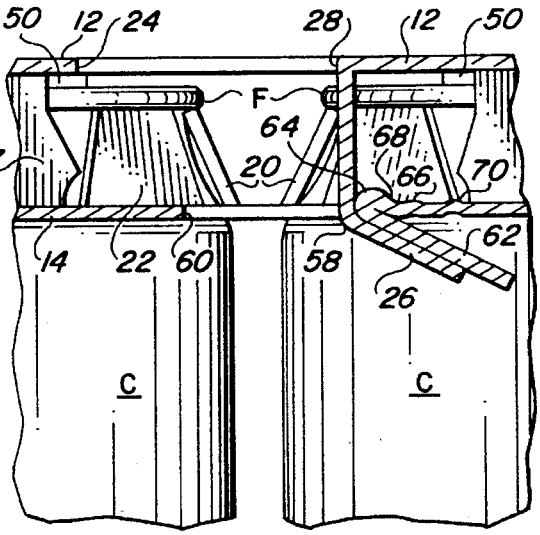
FIG. 7 is an enlarged partial transverse sectional view similar to that of FIG. 6, but showing the carrier with the finger hole tabs after they have been activated.

When the carrier is at rest, prior to a user activating the finger hole tabs, the finger hole tabs 26 of the top panel and the finger hole tabs 62 of the bottom panel are aligned in flat unfolded condition. This condition is illustrated in FIGS. 5 and 6. When a user inserts thumb and finger through the aligned finger holes the tabs 26 are folded down about their fold lines 28, allowing the thumb and finger to engage the finger hole tabs 62 to fold them down about their score lines 64. The tabs 62 do not fold down about the arcuate score lines 66 since their curved shape does not permit a normal folding or pivoting action to take place. When the tabs 62 are folded back about their straight transverse score lines 64, however, the squeezing movement of the thumb and finger toward each other as a user grips the finger holes while lifting the carrier causes the segments 68 of the bottom panel to pivot up for a limited distance about the score line 66, lifting the score line 64. This condition is illustrated in FIG. 7, which omits the user's finger or thumb for the sake of clarity.

Since the folding action of the segments 68 is limited due to the connecting curved score line 66, the segments provide a very solid support which buttresses the finger hole tabs 62 and provides firm resistance to the pressures exerted by the thumb and finger during lifting. The dimensions of the tabs and inner support segments may vary, but should be such that the score lines 64 are free to fold up during lifting as illustrated in FIG. 7. The transverse fold lines 58 in the finger hole tabs 26 allow these tabs to fold as necessary to enable a user's fingers to extend down into the finger holes in the bottom panel.

The presence of the oppositely curved score line 70 in the bottom panel provides an additional buttressing function which prevents tearing of the bottom panel area between the score lines 66 and 70 and failure of the bottom panel strip extending between the fold lines 45 of the interior support tabs 47.

It will now be clear that the invention improves the strength of paperboard carriers designed to carry articles by their top portions by strengthening the connection between the supplemental glue flaps and the bottom panel while being able to tightly draw the carrier about the top portions of the articles. Potential tearing of the bottom panel between the finger holes is resisted by the buttressing effect produced by the areas between the straight and curved score lines adjacent the finger holes and in the area between the finger holes. The construction allows support tabs to be provided substantially entirely about the entire periphery of the articles without interfering with or weakening the supplemental glue flap connections and the adjacent support tabs.

It will be understood that although the invention has been described in connection with a carrier adapted to hold a group of beverage cans, the carrier could be designed to hold other types of flanged articles. The carrier obviously can be designed to hold fewer or more articles than the six beverage cans illustrated in the drawing.

It should now be appreciated that the invention need not necessarily be limited to all the specific details described in connection with the preferred embodiment, but that changes to certain features which do not alter the overall basic function and concept of the invention may be made without departing from the spirit and scope of the invention defined in the appended claims.

What is claimed is:

1. A package containing a plurality of articles each of which includes an upper portion having an upper surface and an outwardly projecting lip, comprising:

a top panel;

a bottom panel spaced from the top panel and connected thereto by side panels;

the bottom panel containing a plurality of apertures through which the upper portions of the articles extend;

a plurality of support tabs foldably connected to the bottom panel adjacent the apertures and extending generally toward the top panel, the support tabs having support edges engaging the lip of an associated article;

one of the support tabs associated with at least one of the apertures being connected to a flap, the flap overlying at least a portion of the upper surface of an associated article; and said one support tab having an opening therein, the opening including an edge which is the support edge of said one support tab.

2. A package as defined in claim 1, wherein the flap is glued to the top panel.

3. A package as defined in claim 2, wherein the flap is connected to said one support tab by a fold line.

4. A package as defined in claim 2, wherein one of the support tabs associated with each of the apertures is connected to a flap, each flap overlying at least a portion of an associated article.

5. A package as defined in claim 4, wherein each said one support tab is connected to the bottom panel along a fold line extending substantially longitudinally of the package.

6. A package as defined in claim 5, wherein the articles are arranged in two adjacent rows, each row containing a plurality of articles.

7. A package as defined in claim 6, wherein each said one support tab in one row is adjacent to and opposite one of said one support tabs in the other row, the fold line connecting each said one support tab in one row being spaced from and substantially parallel to the fold line connecting an adjacent said one support tab in the other row.

8. A package as defined in claim 7, wherein the support tabs associated with each aperture include a support tab connected to the bottom panel substantially along a fold line connecting the bottom panel to a side panel, the support tabs so connected being located opposite said one support tab of each associated aperture.

9. A package as defined in claim 6, wherein at least the upper portions of the articles are cylindrical.

10. A package as defined in claim 9, wherein the articles are beverage cans.

11. A package as defined in claim 6, including spaced finger holes in the top and bottom panels, the finger holes in the top panel overlying the finger holes in the bottom panel, each bottom panel finger hole having an inner transverse edge and being at least partially covered by a tab connected to the bottom panel by a score line extending along said inner transverse edge, the bottom panel including a second transverse score line located adjacent each of the first transverse score lines, the ends of each second transverse score line extending substantially from the ends of the adjacent inner transverse edge.

12. A package as defined in claim 11, wherein the second transverse lines are arcuate.

13. A package as defined in claim 12, including an additional arcuate score line spaced from and opposite each arcuate second transverse score line, each associated additional score line and second transverse score line being convex with respect to each other.

14. A package as defined in claim 13, wherein each finger hole in the top panel has an inner transverse edge and is at least partially covered by a tab connected to the top panel by a fold line extending along said inner transverse edge, each top panel finger hole tab including an intermediate transverse fold line located so that in use the portion of each top panel finger hole tab between the two fold lines thereof extends between the top and bottom panel and the portion extending outwardly of the intermediate transverse fold line extends beneath the bottom panel and beneath an associated folded-back bottom panel finger hole tab.

15. A blank capable of being formed into a carrier for supporting a plurality of articles each of which has an upper portion including an upper surface and an outwardly projecting lip, comprising:

a top panel section;

a bottom panel section;

a first side panel section extending between the top and bottom panel sections and being connected thereto along top and bottom fold lines;

a second side panel section connected to one of the top or bottom panel sections along a fold line;

a flap foldably connected to the second side panel section, the flap being overlapped by and adhered to the other of the top or bottom sections in a carrier formed from the blank;

the bottom panel section containing a plurality of apertures adapted to receive the upper portions of the articles;

a plurality of support tabs foldably connected to the bottom panel section adjacent the apertures and adapted to be folded out of the plane of the bottom panel by articles being moved into position through the apertures, the support tabs having support edges which engage the lips of associated articles in a carrier formed from the blank;

one of the support tabs associated with at least one of the apertures being connected to a flap, the flap extending over a substantial portion of the aperture and overlying at least a portion of the upper surface of an associated article in a carrier formed from the blank; and said one support tab having an opening therein, the opening including an edge which is the support edge of said one support tab.

16. A blank as defined in claim 15, wherein the flap is connected to said one support tab by a fold line.

17. A blank as defined in claim 16, wherein one of the support tabs associated with each of the apertures is connected to a flap, each flap extending over a substantial portion of the associated aperture.

18. A blank as defined in claim 17, wherein the apertures are arranged in two adjacent rows, each row containing a plurality of apertures, each said one support tab in one row is adjacent to and opposite one of said one support tabs in the other row, the fold line connecting each said one support tab in one row being spaced from and substantially parallel to the fold line connecting an adjacent said one support tab in the other row.

19. A blank as defined in claim 18, wherein the support tabs associated with each aperture include a support tab connected to the bottom panel section substantially along a fold line connecting the bottom panel section to a side panel section, the support tabs so connected being located opposite said one support tab of each associated aperture.

20. A blank as defined in claim 18, including spaced finger holes in the top and bottom panel sections, the finger holes in the top panel section overlying the finger holes in the bottom panel section in a carrier formed from the blank, each bottom panel finger hole having an inner transverse edge and being at least partially covered by a tab connected to the bottom panel section by a score line extending along said inner transverse edge, the bottom panel section including a second transverse score line located adjacent each of the first transverse score lines, the ends of each second transverse score line extending substantially from the ends of the adjacent inner transverse edge.

21. A blank as defined in claim 20, wherein the second transverse lines are arcuate, the bottom panel section including an additional arcuate score line spaced from and opposite each arcuate second transverse score line, each associated additional score line and second transverse score line being convex with respect to each other.

22. A blank as defined in claim 21, wherein each finger hole in the top panel section has an inner transverse edge and is at least partially covered by a tab connected to the top panel by a fold line extending along said inner transverse edge, each top panel finger hole tab including an intermediate transverse fold line located so that in use the portion of each top panel finger hole tab between the two fold lines thereof extends between the top and bottom panel of a carrier formed from the blank and the portion extending outwardly of the intermediate transverse fold line extends beneath the bottom panel and beneath an associated folded-back bottom panel finger hole tab of such a carrier.

* * * * *